US009918600B2

(12) United States Patent
Oka et al.

(10) Patent No.: US 9,918,600 B2
(45) Date of Patent: Mar. 20, 2018

(54) SELF-PROPELLED ELECTRIC VACUUM CLEANER

(71) Applicant: Sharp Kabushiki Kaisha, Osaka-shi, Osaka (JP)

(72) Inventors: Yasuhiro Oka, Osaka (JP); Naoko Umehara, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 266 days.

(21) Appl. No.: 14/916,035

(22) PCT Filed: Jul. 22, 2014

(86) PCT No.: PCT/JP2014/069336

§ 371 (c)(1),
(2) Date: Mar. 2, 2016

(87) PCT Pub. No.: WO2015/098161

PCT Pub. Date: Jul. 2, 2015

(65) Prior Publication Data

US 2016/0206164 A1 Jul. 21, 2016

(30) Foreign Application Priority Data

Dec. 27, 2013 (JP) ..... 2013-272223

(51) Int. Cl.
*A47L 5/30* (2006.01)
*A47L 9/04* (2006.01)
*A47L 9/28* (2006.01)

(52) U.S. Cl.
CPC ..... *A47L 5/30* (2013.01); *A47L 9/0472* (2013.01); *A47L 9/2826* (2013.01);
(Continued)

(58) Field of Classification Search
CPC ..... A47L 5/30; A47L 9/0472; A47L 9/2826; A47L 9/2894; A47L 2201/04;
(Continued)

(56) References Cited

U.S. PATENT DOCUMENTS 9,038,233 B2 * 5/2015 Jones ..... A47L 5/30 15/319
2007/0244610 A1 * 10/2007 Ozick ..... A47L 5/30 701/23
2008/0282494 A1 * 11/2008 Won ..... A47L 5/30 15/319

FOREIGN PATENT DOCUMENTS

JP 2012-130781 A 7/2012

* cited by examiner

*Primary Examiner* — Robert Scruggs
(74) *Attorney, Agent, or Firm* — Keating & Bennett, LLP

(57) ABSTRACT

A self-propelled electric vacuum cleaner includes: a vacuum cleaner main body; a running section for causing the vacuum cleaner main body to run on a floor; a suction section for suctioning dust; a side brush for sweeping the dust on the floor, to the suction section; a floor detection sensor for detecting whether or not there is the floor; and a control section for controlling and driving the running section, the suction section and the side brush in response to an output of the floor detection sensor, in which the side brush includes a rotating shaft coaxially having a through-hole, and a plurality of brush bundles radially spread from one end of the rotating shaft, wherein the floor detection sensor includes an optical sensor provided adjacent to the other end of the rotating shaft to detect whether or not there is an object, through the through-hole.

5 Claims, 14 Drawing Sheets

(52) U.S. Cl.
CPC ..... *A47L 9/2894* (2013.01); *A47L 2201/04* (2013.01); *A47L 2201/06* (2013.01)

(58) Field of Classification Search
CPC .. A47L 2201/06; A47L 9/2842; A47L 9/2857; A47L 2201/00
See application file for complete search history.

SELF-PROPELLED ELECTRIC VACUUM CLEANER

TECHNICAL FIELD

The present invention relates to a self-propelled electric vacuum cleaner.

BACKGROUND ART

As a background technique of the present invention, a self-propelled electric vacuum cleaner including, on a surface facing the floor of a chassis, multiple driving wheels, a dust suction port, a main cleaning brush, a side brush and a floor detection sensor which detects a cliff (large step) on a floor is known (see, for example, Patent Document 1).

PRIOR ART DOCUMENT

Patent Document

Patent Document 1: Japanese Patent Laid-open Publication No. 2012-130781

SUMMARY OF THE INVENTION

Problems to be Solved by the Invention

However, such a conventional self-propelled electric vacuum cleaner includes, on the surface facing the floor of the chassis, components such as the multiple driving wheels, the dust suction port, the main cleaning brush and the side brush. Therefore, such a conventional self-propelled electric vacuum cleaner has a problem that it is not easy to dispose the floor detection sensor to effectively detect a floor without being interfered by these components and the degree of design freedom is limited.

The present invention has been made in light of such a situation, and provides a self-propelled electric vacuum cleaner in which a floor detection sensor can be disposed without being interfered by other components.

Solutions to the Problems

The present invention provides a self-propelled electric vacuum cleaner which includes a vacuum cleaner main body; a running section which causes the vacuum cleaner main body to run on a floor; a suction section which suctions dust; a side brush which guides the dust on the floor, to the suction section; a floor detection sensor which detects whether or not there is the floor; and a control section which controls the running section, the suction section and the side brush to drive in response to an output of the floor detection sensor, and in which the side brush includes a rotating shaft which coaxially includes a through-hole, and a plurality of brush bundles which radially stretches from one end of the rotating shaft, and the floor detection sensor is an optical sensor which is provided at a side of an other end of the rotating shaft and detects whether or not there is an object through the through-hole.

Effects of the Invention

The side brush includes the rotating shaft which coaxially includes a through-hole and a plurality of brushes which radially stretches from the lower end of the rotating shaft, and the floor detection sensor is the optical sensor which detects whether or not there is an object through the through-hole of the rotating shaft of the side brush, so that it is possible to dispose the floor detection sensor without being interfered by the driving wheels, the dust suction port, the main cleaning brush and the side brush, and effectively detect whether or not there is an object.

EMBODIMENTS OF THE INVENTION

Figure 1:
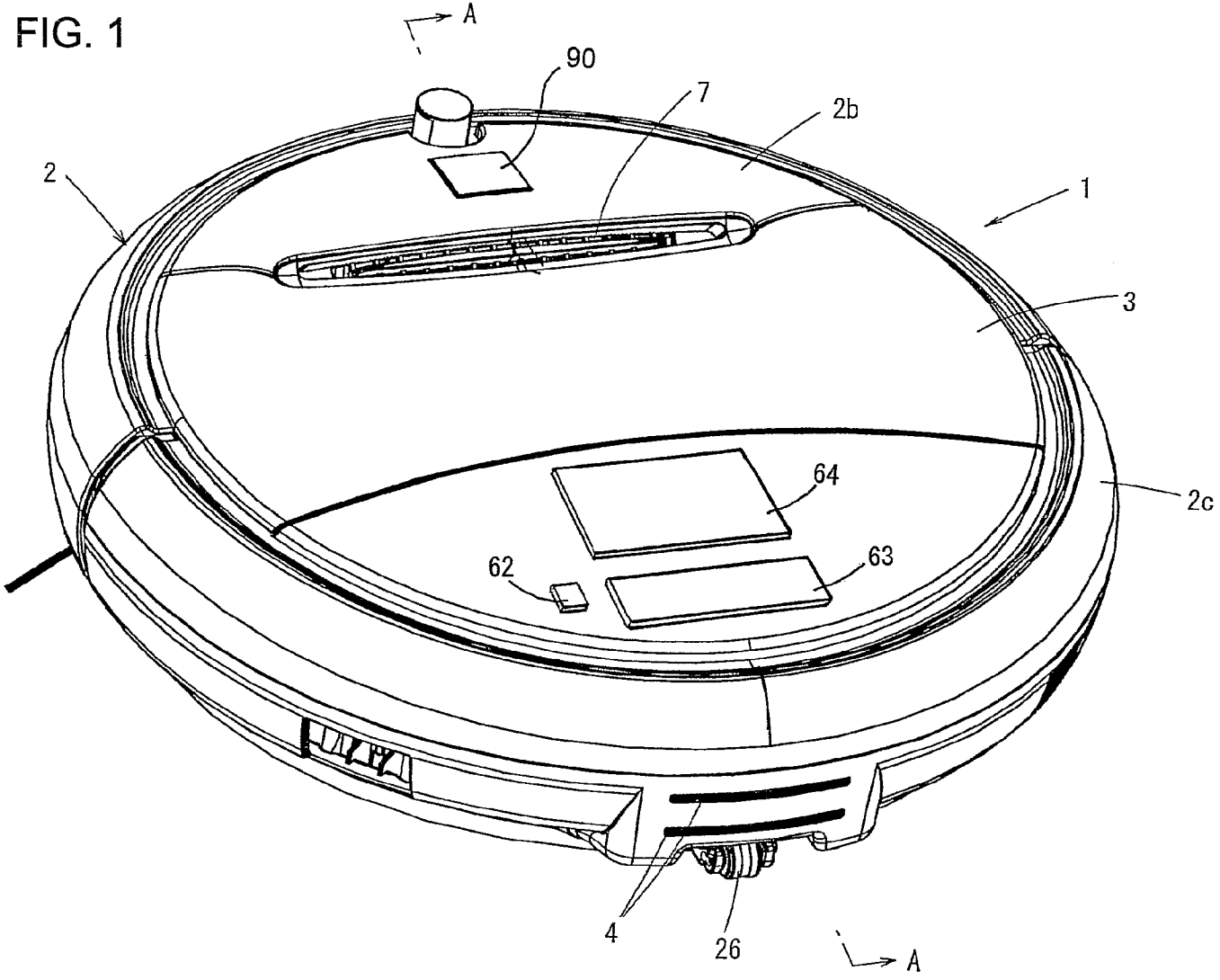
FIG. 1 is a perspective view showing a top surface side of a self-propelled electric vacuum cleaner according to Embodiment 1 of the present invention.

A self-propelled electric vacuum cleaner according to the present invention includes: a vacuum cleaner main body; a running section which causes the vacuum cleaner main body to run on a floor; a suction section which suctions dust; a side brush which guides the dust on the floor, to the suction section; a floor detection sensor which detects whether or not there is the floor; and a control section which controls the running section, the suction section and the side brush to drive in response to an output of the floor detection sensor, and in which the side brush includes a rotating shaft which coaxially includes a through-hole, and a plurality of brush bundles which radially stretches from one end of the rotating shaft, and the floor detection sensor is an optical sensor which is provided at a side of an other end of the rotating shaft and detects whether or not there is an object through the through-hole.

The self-propelled electric vacuum cleaner may further include a first gear which is coaxially coupled detachably with the other end of the rotating shaft of the side brush; a support section which rotatably supports the first gear, and a second gear which enmeshes with the first gear to transmit a rotation force to the side brush, and the first gear may include a through-hole which continues to the through-hole of the side brush, and the optical sensor may detect whether or not there is the object, through both of the through-holes of the side brush and the first gear.

The first gear and the second gear may compose a worm gear, the first gear may be a worm wheel and the second gear may be a worm.

The optical sensor preferably includes an infrared light emitting element and an infrared light receiving element.

The self-propelled electric vacuum cleaner may further include an electric motor which is coupled to the second gear.

The present invention will be described below by using embodiments of a self-propelled electric vacuum cleaner shown in the drawings. The embodiments by no means limit the present invention.

Embodiment 1

(1) Configuration of Self-Propelled Electric Vacuum Cleaner

Figure 2:
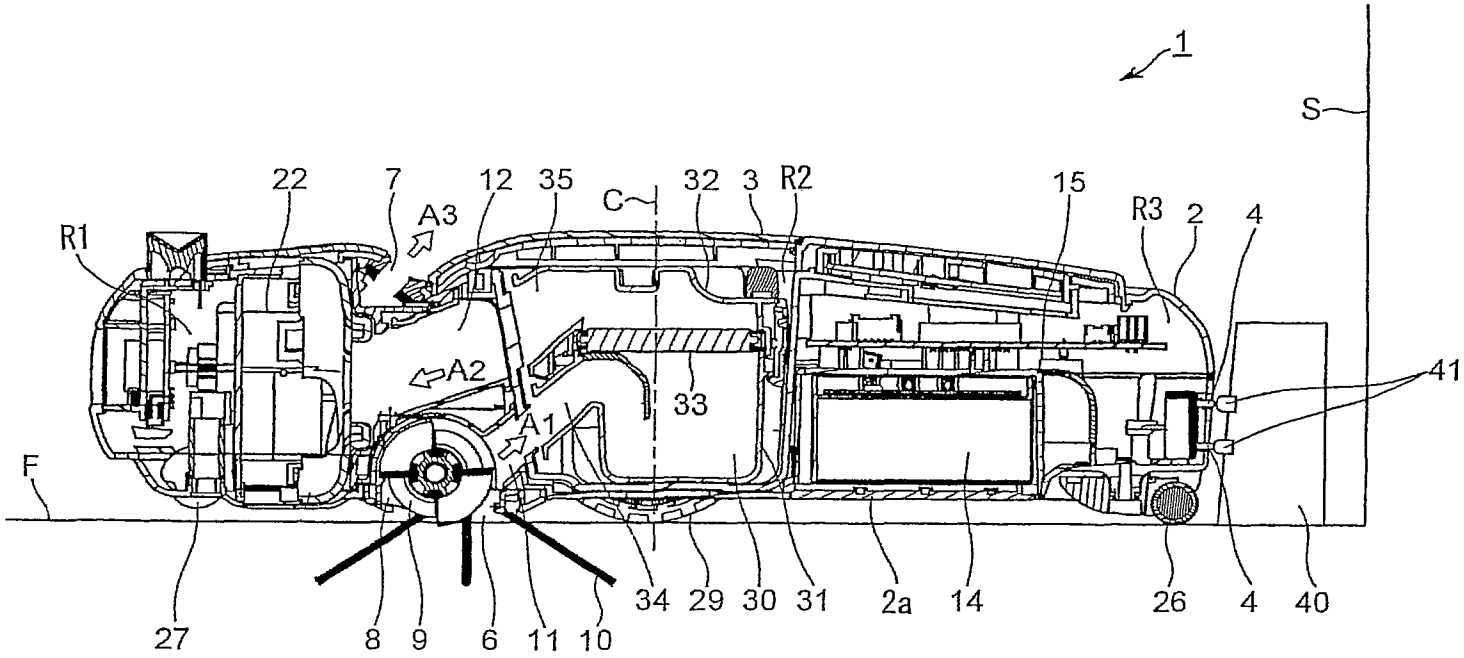
FIG. 2 is a sectional view taken from an arrow view A-A.
Figure 3:
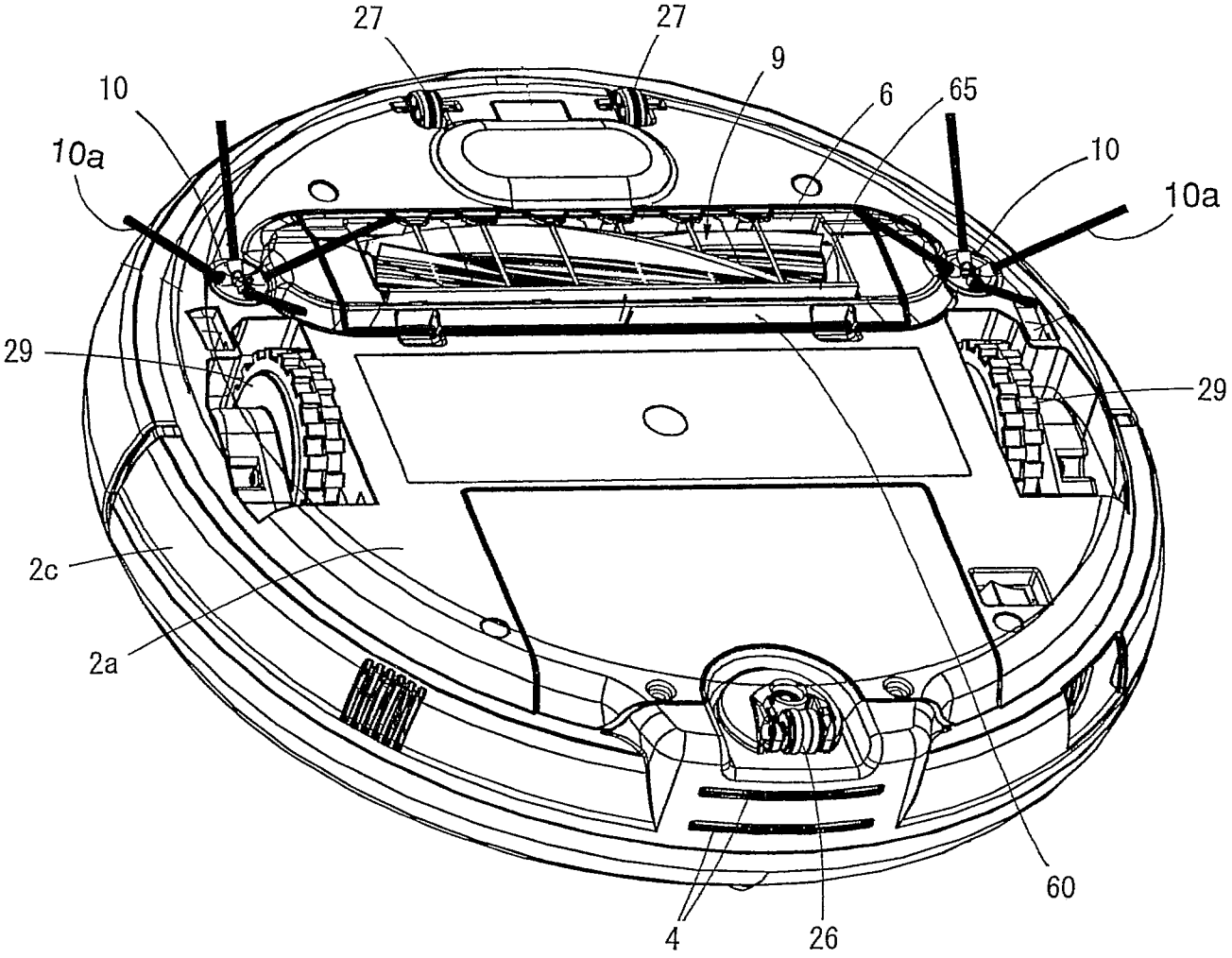
FIG. 3 is a perspective view showing a bottom surface side of the self-propelled electric vacuum cleaner shown in FIG. 1.
Figure 4:
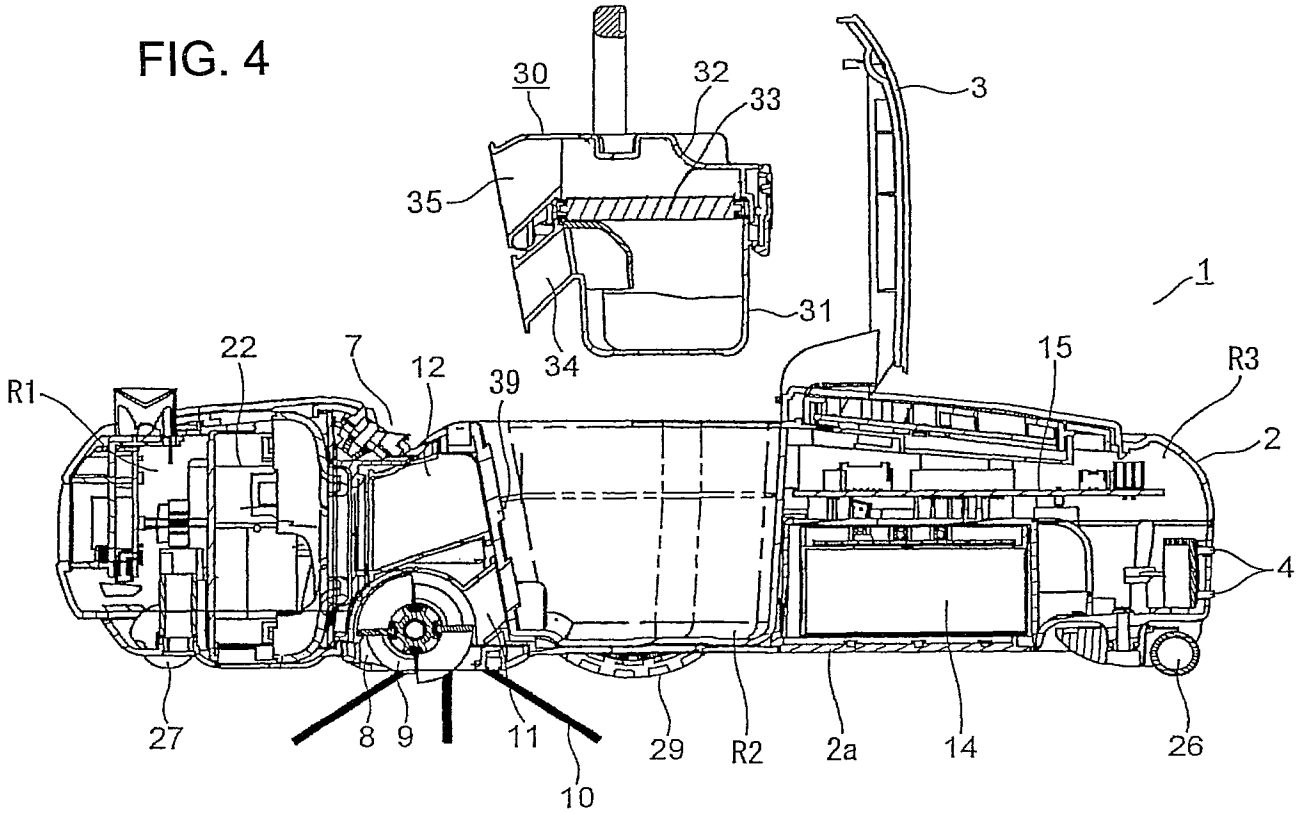
FIG. 4 is a view showing a state where a dust collector has been removed, and corresponding to FIG. 2.

FIG. 1 is a perspective view showing a top surface of a self-propelled electric vacuum cleaner according to the present invention. FIG. 2 is a sectional view taken from an arrow view A-A. FIG. 3 is a perspective view showing a bottom surface of the self-propelled electric vacuum cleaner shown in FIG. 1. FIG. 4 is a view showing a state where a dust collector has been removed, and corresponding to FIG. 2.

As shown in FIGS. 1 to 3, a self-propelled electric vacuum cleaner 1 according to an embodiment is configured to clean a floor by running on a floor (cleaning target surface) F (FIG. 2) of a place at which the self-propelled electric vacuum cleaner 1 is disposed, suctioning air including dust on the floor F and exhausting air whose dust has been removed.

The self-propelled electric vacuum cleaner 1 includes a housing 2 of a disk shape, and, inside and outside of this housing 2, a rotary brush 9, a side brush 10, a dust box (referred to as a dust collector) 30, an electric blower 22, a pair of driving wheels 29, a rear wheel 26 and a front wheel 27 are provided.

In this self-propelled electric vacuum cleaner 1, a portion at which the front wheel 27 is disposed is a front portion, a portion at which the rear wheel 26 is disposed is a rear portion, and a portion at which the dust collector 30 is disposed is an intermediate portion.

The housing 2 includes a bottom plate 2*a* which is circular when seen from a plan view and includes a suction port 6 formed at a portion near a boundary between the front portion and the intermediate portion, a top plate 2*b* which includes at the intermediate portion a cap 3 which is opened and closed to put and take the dust collector 30 in and out from the housing 2, and a side plate 2*c* which is provided along outer circumferences of the bottom plate 2*a* and the top plate 2*b*.

Further, a plurality of holes through which lower portions of the front wheel 27, a pair of driving wheels 29 and the rear wheel 26 protrude from an inside of the housing 2 is formed in the bottom plate 2*a*, and an exhaust port 7 is formed at a boundary between the front portion and the intermediate portion of the top plate 2*b*. In addition, the side plate 2*c* is divided into front and rear portions, and a front side portion is provided to be able to be displaced to function as a bumper.

Further, as shown in FIG. 1, an external light detection sensor 90 which detects strong external light such as sunlight, and the exhaust port 7 are provided at a front portion of the top plate 2*b* of the housing 2. At a rear portion of the top plate 2*b* of the housing 2, a power switch (push button switch) 62, an input section (input panel) 63 which includes an activation switch operated by a user, a switch described below for checking whether or not a collected dust amount is full and a switch for inputting other various conditions, and a display section display section (display panel) 64 which displays a warning for that a collected dust amount is full or displays a status of the vacuum cleaner are provided.

Further, FIG. 4 is a view showing a state where the dust collector 30 has been removed and corresponding to FIG. 2. As shown in FIG. 4, inside the housing 2, a front storage room R1 which stores the electric blower 22 is provided at a front portion, and an intermediate storage room R2 which stores the dust collector 30 is provided at an intermediate portion.

Further, a rear storage room R3 which stores a control substrate 15 of a control section, a battery 14 (storage battery), and charging terminals 4 are provided at a rear portion, and a suction path 11 and an exhaust path 12 are provided near a boundary between the front portion and the intermediate portion.

The suction path 11 connects a suction port 6 (FIG. 3) and the intermediate storage room R2, and the exhaust path 12 connects the intermediate storage room R2 and the front storage room R1. In addition, each of the storage rooms R1, R2 and R3, the suction path 11 and the exhaust path 12 are provided inside the housing 2 and are partitioned by a partitioning wall 39 which forms spaces for these components.

A pair of driving wheels 29 are fixed to a pair of rotating shafts intersecting a center line C (FIG. 2) passing a center of the housing 2 at a right angle. When a pair of driving wheels 29 rotate in a same direction, the housing 2 moves forward and backward and, when each driving wheel 29 rotates in an opposite direction, the housing 2 rotates about the center line C.

The rotating shafts of a pair of driving wheels 29 are coupled to individually obtain a rotation force from a pair of driving wheel motors, and each motor is fixed to the bottom plate 2*a* of the housing directly or via a suspension mechanism.

The front wheel 27 is a roller, and is rotatably provided to part of the bottom plate 2*a* of the housing 2 to come into contact with a step which shows up on a route, and to float a little from the floor F (FIG. 2) which the driving wheel 29 comes into contact with such that the housing 2 can easily get over the step.

The rear wheel 26 is a caster wheel, and is rotatably provided to part of the bottom plate 2*a* of the housing 2 such that the driving wheels 29 come into contact with the floor F.

Thus, a pair of driving wheels 29 are disposed at a middle of the housing 2 in forward and backward directions, and the front wheel 27 is floated from the floor F to allocate weights in the forward and backward directions for the housing 2 such that the weight of the self-propelled electric vacuum cleaner 1 can be supported by a pair of driving wheels 29 and the rear wheel 26. Consequently, it is possible to guide dust ahead of a route, to the suction port 6 without being blocked by the front wheel 27.

The suction port 6 in FIG. 3 is an open surface of a recess 8 (FIG. 2) formed in the bottom surface of the housing 2 to face the floor F, and the suction port 6 is formed by fitting a bottom plate 60 (see FIG. 3) as a suction body to the recess 8. In this recess 8, the rotary brush 9 which rotates about a shaft center parallel to the bottom surface of the housing 2 is provided, and, at both left and right sides of the recess 8, the side brush 10 which rotates about a rotating shaft center vertical to the bottom plate 2*a* is provided.

The rotary brush 9 is formed by spirally planting the brush in an outer circumference surface of a roller which is a rotating shaft. The side brush 10 is formed by radially providing four brush bundles 10*a* at a lower end of the rotating shaft.

In addition, as described below, the rotating shaft of the rotary brush 9 is coupled to a brush driving motor, and the rotating shaft of the side brush 10 is coupled to a side brush driving motor.

Further, as shown in FIG. 3, at a rear rim of the suction port 6, a napping brush 65 serving as a capturing member of a blade shape which captures dust which has not been suctioned by the suction port 6 and prevents the dust from scattering is provided.

The control substrate 15 (FIGS. 2 and 4) includes control circuits which compose a control system (FIG. 5) described below, i.e., the control circuits such as a microcomputer which controls the self-propelled electric vacuum cleaner 1 and a motor driver circuit which drives each element such as the driving wheels 29, the rotary brush 9, the side brush 10 and the electric blower 22.

At a rear end of the side plate 2*c* of the housing 2, the charging terminals 4 which charge the battery 14 are provided. The self-propelled electric vacuum cleaner 1 which cleans a room while running in the room returns to a charging station 40 (FIG. 2) installed in the room. Thus, the charging terminals 4 contact terminal sections 41 provided to the charging station 40, and charge the battery 14. The charging station 40 connected to a commercial power supply (outlet) is usually installed along a sidewall S in a room.

The dust collector 30 is generally stored in the intermediate storage room R2 above the shaft center of the rotating shaft of both of the driving wheels 29 in the housing 2, and dust collector 30 can be taken out or put in by opening the cap 3 of the housing 2 as shown in FIG. 4 to discard dust captured in the dust collector 30.

The dust collector 30 includes a collected dust container 31 which has an opening, a filter 33 which covers the opening of the collected dust container 31 and a cover 32 which covers the filter 33 and the opening of the collected dust container 31. The cover 32 and the filter 33 are pivotally supported rotatably at an opening end rim at a front side of the collected dust container 31.

At a front of a sidewall of the collected dust container 31, an inflow path 34 which continues to the suction path 11 of the housing 2, and an exhaust path 35 which continues to the exhaust path 12 of the housing 2 in a state where the dust collector 30 is stored in the intermediate storage room R2 of the housing 2 are provided.

(2) Assembly of Side Brush and Floor Detection Sensor

Figure 5:
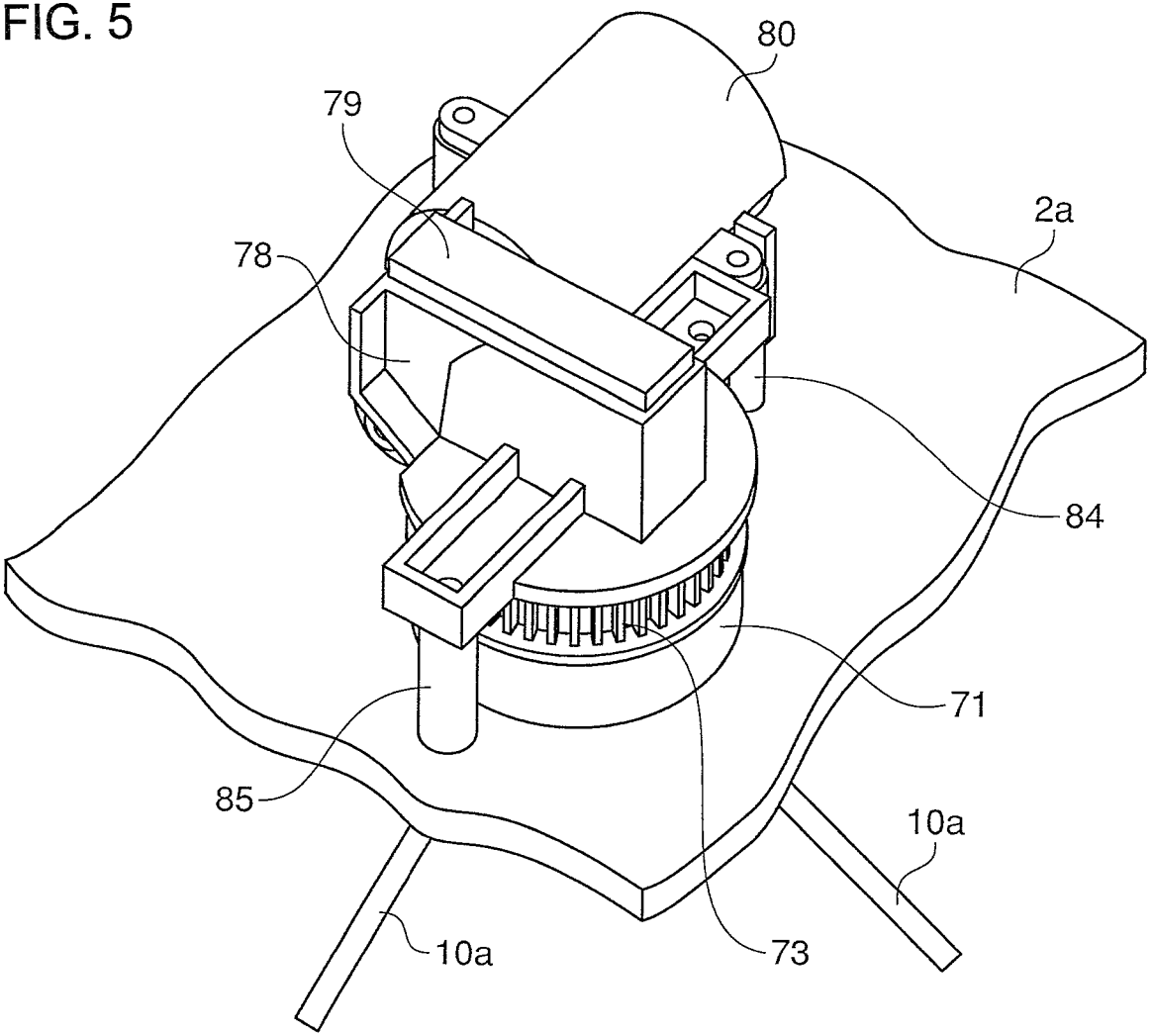
FIG. 5 is a perspective view of main parts of the self-propelled electric vacuum cleaner shown in FIG. 1.
Figure 6:
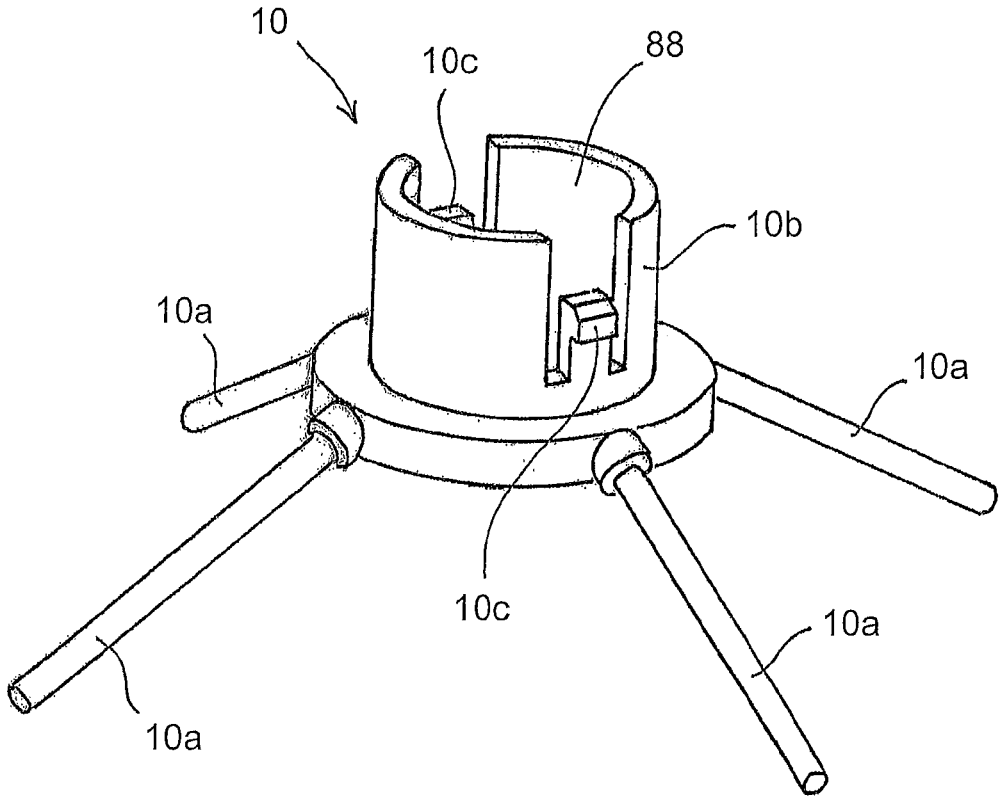
FIG. 6 is a perspective view of a side brush of the self-propelled electric vacuum cleaner shown in FIG. 1.
Figure 7:
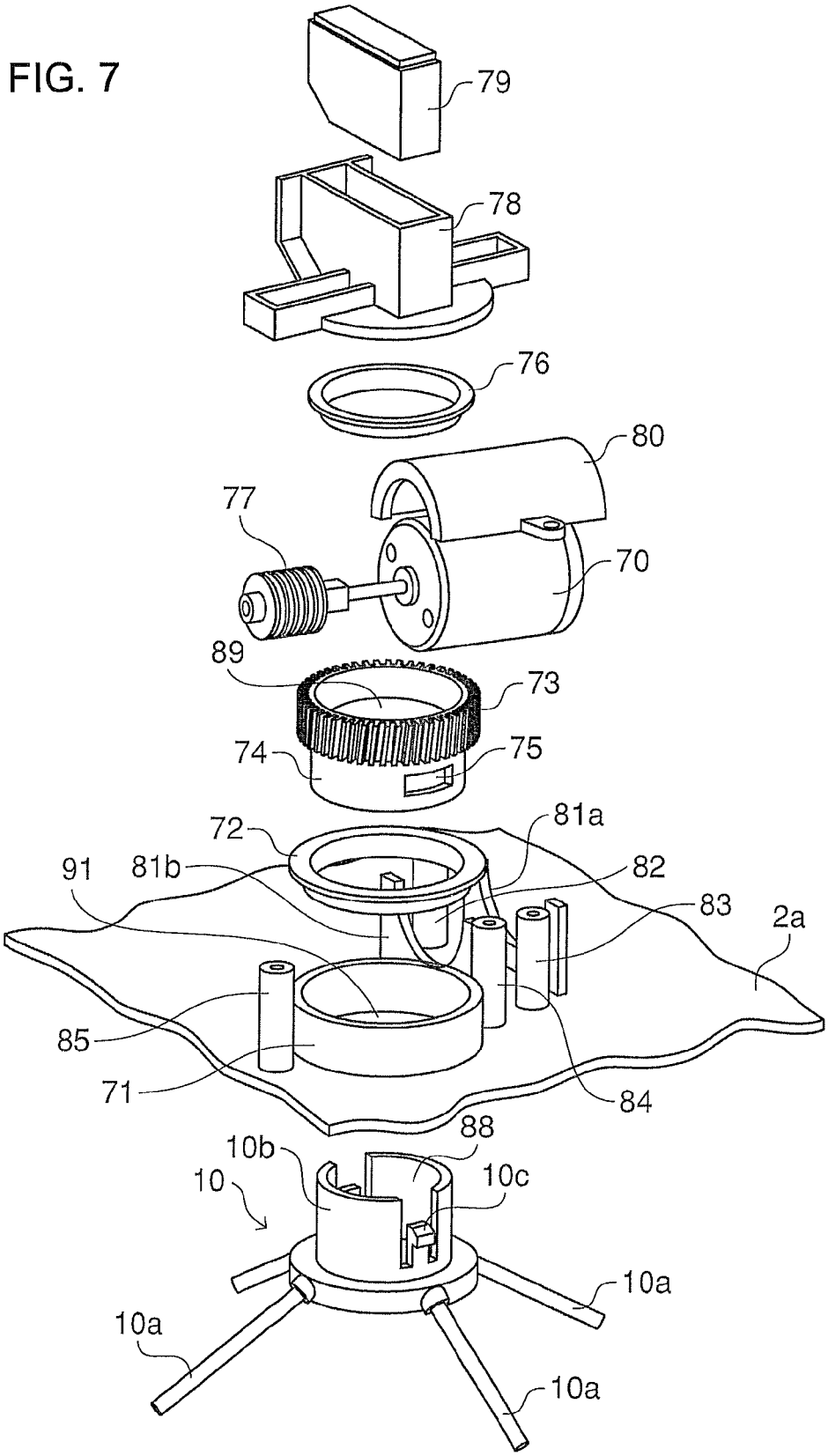
FIG. 7 is an exploded perspective view of the main parts shown in FIG. 5.
Figure 8:
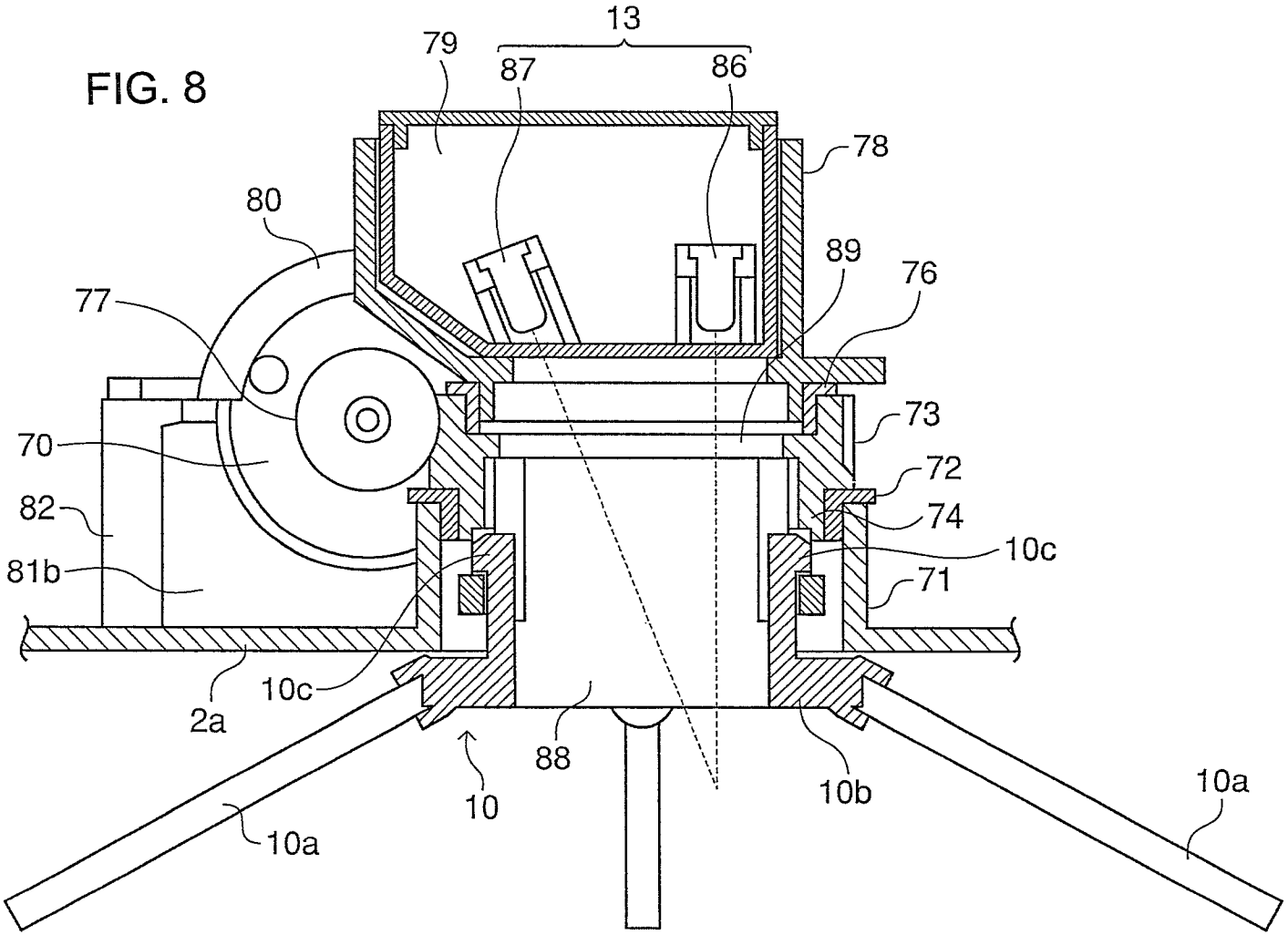
FIG. 8 is a longitudinal sectional view of the main parts shown in FIG. 5.

FIG. 5 is a perspective view showing an assembly of the side brush and the floor detection sensor. FIG. 6 is a perspective view of the side brush. FIG. 7 is an exploded perspective view of the assembly shown in FIG. 5. FIG. 8 is a longitudinal sectional view of the assembly shown in FIG. 5.

As shown in FIG. 6, the side brush 10 includes a cylindrical rotating shaft 10*b* which coaxially includes a through-hole 88, the four stick brushes 10*a* which radially stretch from a flange at an outer circumference of a lower end of the rotating shaft 10*b*, and two elastic locking claws 10*c* which are formed by cutting two portions of the rotating shaft 10*b* in a vertical direction and protrude from an outer circumference surface of the rotating shaft 10*b*.

The assembly shown in FIG. 5 will be described below in detail. As shown in FIGS. 7 and 8, on the top surface of the bottom plate 2*a*, a cylindrical portion 71 is arranged to stand at a periphery of a hole 91 formed in the bottom plate 2*a*, and motor support plates 81*a* and 81*b*, motor fixing columns 82 and 83 and fixing member fixing columns 84 and 85 are arranged to stand. Further, a metal washer 72 serving as a bearing which rotatably supports a rotating shaft 74 of a worm wheel 73 is fitted into an upper end of the cylindrical portion 71. The worm wheel 73 and the rotating shaft 74 include a through-hole 89 coaxially formed in the vertical direction, and include, in side surfaces, two locking windows 75 which elastically receive and releasably lock with the two elastic locking claws 10*c* of the side brush 10.

Further, the rotating shaft 74 of the worm wheel 73 is fitted to the metal washer 72, and a metal washer 76 serving as a bearing is attached to the worm wheel 73.

Furthermore, an assembly fixing member 78 is fitted to the metal washer 76 from above, and the assembly fixing member 78 is fixed to the fixing member fixing columns 84 and 85 by using screws which are not shown. The side brush 10 is attached by inserting the rotating shaft 10*b* into the through-hole 89 of the rotating shaft 74 from below of the bottom plate 2*a* via the hole 91, and releasably locking the elastic locking claws 10*c* in the locking windows 75.

Meanwhile, a driving motor 70 which drives the side brush 10 is supported by the motor support plates 81*a* and 81*b*, is covered with a motor cover 80 and is fixed to the motor fixing columns 82 and 83 by using screws which are not shown. Further, a worm 77 coupled to an output shaft of the driving motor 70 enmeshes with the worm wheel 73 to compose a pair of worm gears, and a rotation force of the driving motor 70 is transmitted to the rotating shaft 10*b* of the side brush 10.

Furthermore, as shown in FIG. 8, a sensor module 79 is assembled in the assembly fixing member 78 from above. The sensor module 79 includes a light emitting element (infrared light emitting diode) 86 and a light receiving element (phototransistor) 87 which compose the floor detection sensor 13 in a translucent case. Light emitted from the light emitting element 86 is irradiated on an object (floor) via the through-holes 88 and 89, and the reflected light is received by the light receiving element 87 via the through-holes 88 and 89. Consequently, the floor detection sensor 13 can detect whether or not there is a floor, i.e., whether there is a normal floor or a large step (cliff) such as a staircase.

(3) Driving Control of Self-Propelled Electric Vacuum Cleaner

Figure 9:
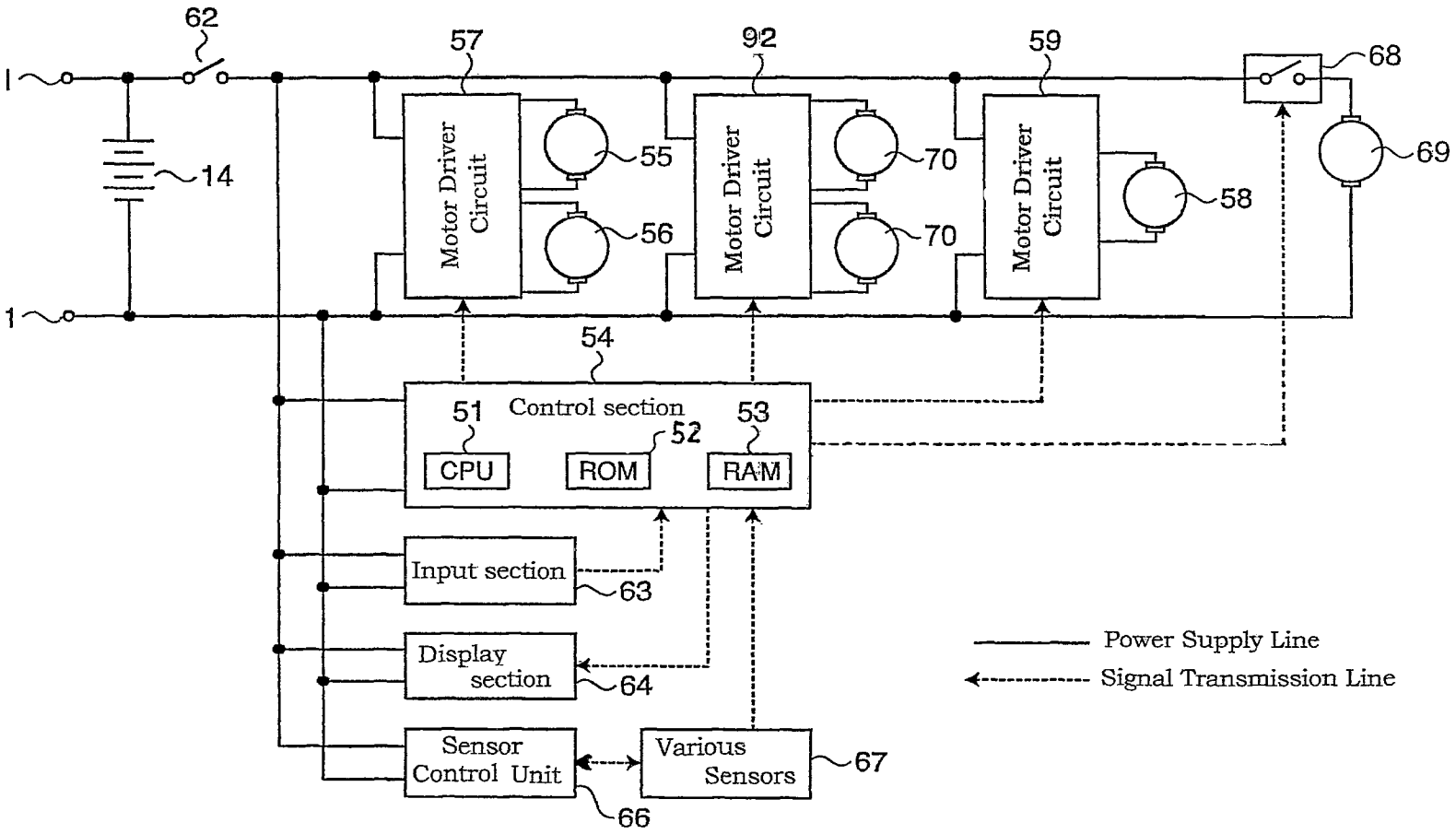
FIG. 9 is a block view showing a control system of the self-propelled electric vacuum cleaner shown in FIG. 1.

As shown in FIG. 9, the control system which controls driving of the entire self-propelled electric vacuum cleaner 1 includes a control section 54 which includes a microcomputer including a CPU 51, a ROM 52 and a RAM 53, a motor driver circuit 57 which controls driving wheel motors 55 and 56 which drive the two driving wheels 29, respectively, a motor driver circuit 59 which controls a brush driving motor 58 which drives the rotary brush 9, a motor driver circuit 92 which controls two driving motors 70 which drive the two side brushes 10, respectively, a switching element 68 which switches between on and off of connection between a DC motor 69 mounted on the electric blower 22, and the battery 14, a power switch 62, a sensor control unit 66 which controls various sensors 67 to drive, the input section 63 and the display sectiondisplay section 64. The various sensors 67 include the floor detection sensor 13 and the external light detection sensor 90.

In addition, a permanent magnet excitation DC motor is used for the DC motor 69.

When the power switch 62 is turned on, output power of the battery 14 is supplied to the motor driver circuits 57, 92 and 59, respectively, and is supplied to the control section 54, the input section 63, the display sectiondisplay section 64 and the sensor control unit 66, respectively.

Further, the CPU 51 of the control section 54 is a central processing unit, and computes signals received from the input section 63 and the various sensors 67 based on a program stored in the ROM 52 in advance, and outputs the signals to the motor driver circuits 57, 92 and 59, a switching element 68 and the display sectiondisplay section 64.

In addition, the RAM 53 temporarily stores various instructions inputted by the user from the input section 63, various operation conditions of the self-propelled electric vacuum cleaner 1 and outputs of the various sensors 65.

Further, the RAM 53 can store a travel map of the self-propelled electric vacuum cleaner 1. The travel map is information related to travelling such as a travelling route or a travelling speed of the self-propelled electric vacuum cleaner 1, and can be stored in the RAM 53 in advance by the user or can be automatically recorded during a cleaning operation of the self-propelled electric vacuum cleaner 1.

(4) Operation of Self-Propelled Electric Vacuum Cleaner

When the user instructs a cleaning operation via the input section 63 to the self-propelled electric vacuum cleaner 1 configured as described above, whether or not the dust collector 30 is attached is first checked, and, when the dust collector 30 is attached, the electric blower 22, the driving wheels 29, the rotary brush 9 and the side brush 10 are driven.

Thus, in a state where the rotary brush 9, the side brush 10, the driving wheels 29 and the rear wheel 26 are in contact with the floor F, the housing 2 suctions air including dust of the floor F through the suction port 6 while running in a predetermined range. In this case, the dust on the floor F is scooped up by rotation of the rotary brush 9 and is guided to the suction port 6. Further, dust at sides of the suction port 6 is guided to the suction port 6 by rotation of the side brush 10.

As indicated by an arrow A1 in FIG. 2, the air including dust having been suctioned into the housing 2 through the suction port 6 passes through the suction path 11 of the housing 2, and flows into the collected dust container 31 through the inflow path 34 of the dust collector 30. An airflow having flowed into the collected dust container 31 flows into a space between the filter 33 and the cover 32 through the filter 33, and is exhausted to the exhaust path 12 through the exhaust path 35. In this case, the dust included in the airflow in the collected dust container 31 is captured by the filter 33, and therefore the dust is deposited in the collected dust container 31.

The airflow having flowed from the dust collector 30 to the exhaust path 12 flows into the front storage room R1 as indicated by an arrow A2 in FIG. 2, and circulates in a first exhaust path and a second exhaust path which are not shown. Further, the airflow is exhausted as clean air whose dust has been removed by the filter 33 from the exhaust port 7 provided at a top surface of the housing 2 toward a rear and diagonally upper direction as indicated by an arrow A3 in FIG. 2.

Thus, the floor F is cleaned. In this case, air is exhausted in the rear and diagonally upper direction from the exhaust port 7, so that it is possible to prevent dust on the floor F from being blown up and improve cleanness in the room.

Further, as described above, the self-propelled electric vacuum cleaner 1 moves forward when the left and right driving wheels 29 normally rotate in the same direction, moves backward when the left and right driving wheels 29 reversely rotate in the same direction, and turns about the center line C when the left and right driving wheels 29 rotate in opposite directions.

When, for example, the self-propelled electric vacuum cleaner 1 is about to reach a large step (cliff) or arrives at a circumference of a cleaning area, or when the self-propelled electric vacuum cleaner 1 collides against an obstacle on a route, the floor detection sensor 13 (FIG. 8) and the sensors which are not shown notify the control section 54 (FIG. 9) of this situation, the driving wheels 29 stop and the left and right driving wheels 29 rotate in the opposite directions to change a direction. Consequently, the self-propelled electric vacuum cleaner 1 can run in an entire installation place or an entire desired range while avoiding a large step or an obstacle.

Further, the self-propelled electric vacuum cleaner 1 is in contact with the floor F via three points of the left and right driving wheels 29 and the rear wheel 26, and a weight is allocated at such a balance that the rear wheel 26 does not float from the floor F even when the self-propelled electric vacuum cleaner 1 makes a sudden stop while moving forward. Hence, the self-propelled electric vacuum cleaner 1 makes a sudden stop before a staircase going downward while moving forward to prevent the self-propelled electric vacuum cleaner 1 from inclining forward and falling downstairs. In addition, the driving wheels 29 are formed by fitting rubber tires having grooves into wheels to prevent slippery even when a sudden stop is made.

Further, the dust collector 30 is disposed above the rotating shafts of the driving wheels 29, so that, even when a weight of dust increases, a weight balance of the self-propelled electric vacuum cleaner 1 is kept.

The self-propelled electric vacuum cleaner 1 returns to the charging station 40 (FIG. 2) when finishing cleaning the room. Thus, the charging terminals 4 come into contact with the terminal sections 41, and charge the battery 14.

(4) Control Circuit of Floor Detection Sensor

In Embodiment 1, the floor detection sensor 13 is controlled to drive by the sensor control unit 66 (FIG. 9). Hereinafter, a control circuit of the floor detection sensor 13 will be described in more detail by using Embodiments 2 and 3.

Embodiment 2

Figure 10:
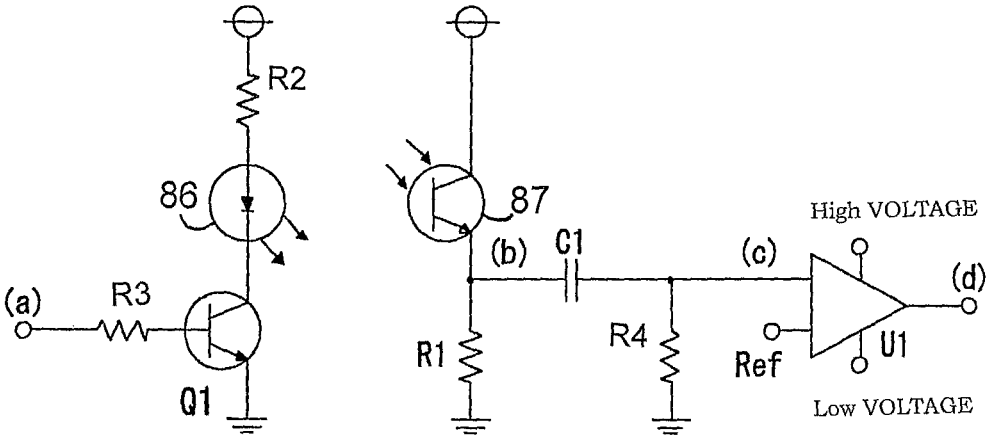
FIG. 10 is an electric circuit diagram showing a control circuit of a floor detection sensor of a self-propelled electric vacuum cleaner according to Embodiment 2 of the present invention.

FIG. 10 shows a control circuit of a floor detection sensor 13 according to Embodiment 2. This control circuit is provided in a sensor control unit 66 in FIG. 9.

As shown in FIG. 10, a DC constant voltage is applied to a light emitting element (infrared light emitting diode) 86 via a resistance R2 and an NPN transistor Q1, and a signal voltage is applied to a base of the transistor Q1 from a node (a) via a resistance R3. Meanwhile, the DC voltage is applied to a light receiving element (phototransistor) 87 via the resistance R1. Further, a terminal voltage of the resistance R1, i.e., a voltage of a node (b) is inputted from the node (c) to a comparator U1 via a DC component elimination circuit (differentiation circuit) including a capacitor C1 and a resistance R4. The inputted voltage is compared with a reference voltage Ref by the comparator U1, and, when the voltage is the reference voltage Ref or more, a node (d) outputs a signal of a "High voltage" and, when the voltage is less than the reference voltage Ref, the node (d) outputs a signal of a "Low voltage".

Figure 12:
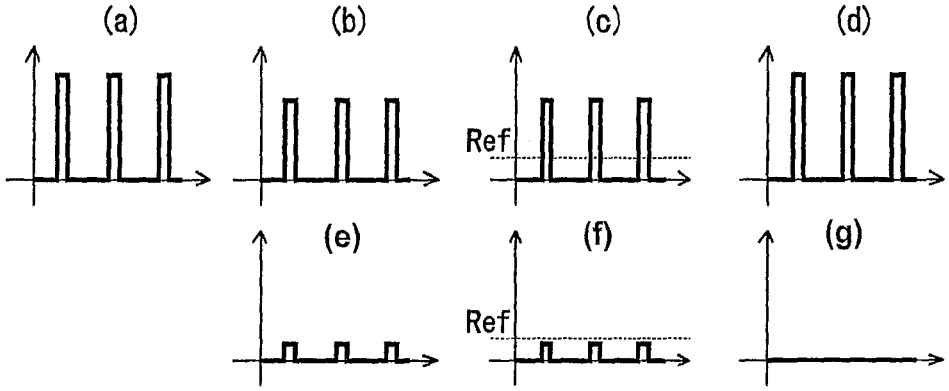
FIG. 12 is a waveform chart showing an operation of an electric circuit shown in FIG. 10.

According to this configuration, when a pulse signal shown in FIG. 12(*a*) is applied to the node (a), the light emitting element (infrared light emitting diode) 86 emits light according to this signal, and irradiates a floor F (FIG. 2) with the light. When the light receiving element (phototransistor) 87 receives the light reflected by the floor F, a signal shown in FIG. 12(*b*) subsequently appears in the node (b). DC components of this signal are eliminated by the DC component elimination circuit, and a signal shown in FIG. 12(*c*) is inputted to the node (c). This signal is compared with the reference voltage Ref by the comparator U1 and has a higher peak value than the reference voltage Ref. Hence, the node (d) outputs a signal shown in FIG. 12(*d*) to a control section 54 (FIG. 9), and the control section 54 recognizes that the floor F normally exists.

Meanwhile, when a vacuum cleaner is about to reach a large step (cliff) and reflected light reflected from the floor F and received by the light receiving element 87 weakens, a signal appearing in the node (b) becomes small as shown in FIG. 12(*e*). AC components of this signal are eliminated, and a signal shown in FIG. 12(*f*) is inputted to the node (c). A voltage of the node (c) is compared with the reference voltage Ref by the comparator U1 and is smaller than the reference voltage Ref, and a signal does not appear in the node (d) as shown in FIG. 12(*g*). Therefore, the control section 54 recognizes that the vacuum cleaner is about to reach a large step (cliff), and causes the vacuum cleaner to stop movement of the vacuum cleaner or change a travelling direction.

Figure 13:
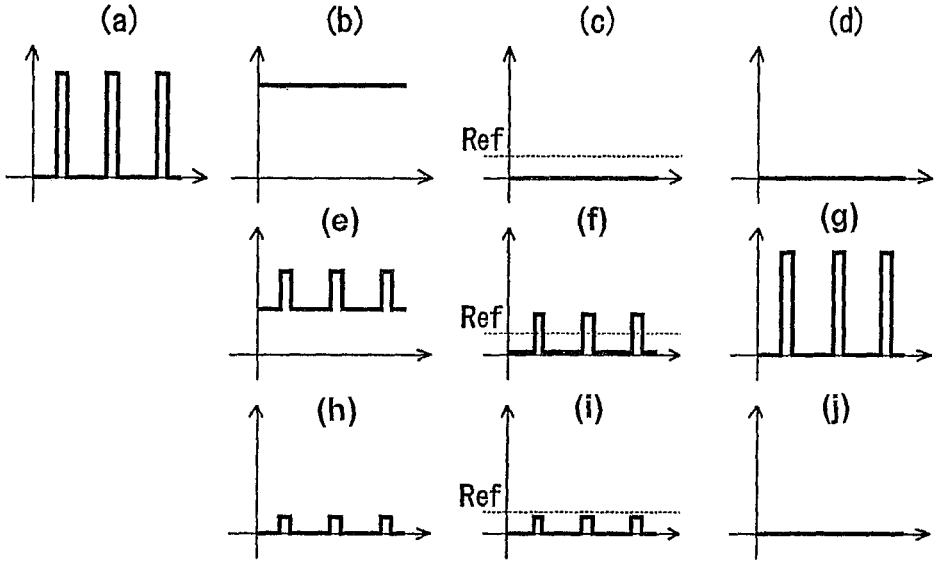
FIG. 13 is a waveform chart showing an operation of an electric circuit shown in FIGS. 10 and 11.

By the way, when the vacuum cleaner is used outdoors, i.e., when strong external light (infrared beam) such as sunlight is reflected by the floor F and enters the light receiving element (phototransistor) 87, the light receiving element 87 is saturated. Hence, even when the node (a) applies a pulse signal shown in FIG. 13(*a*), the light emitting element 86 subsequently emits light, and the light is reflected from a floor, a signal of the node (b) becomes a DC signal which is significant to some degree as shown in FIG. 13(*b*), a signal does not appear in the node (c) and the node (d) as shown in FIGS. 13(*c*) and (*d*), and the control section 54 erroneously recognizes that the floor F does not normally exist, i.e., that there is a large step.

Figure 11:
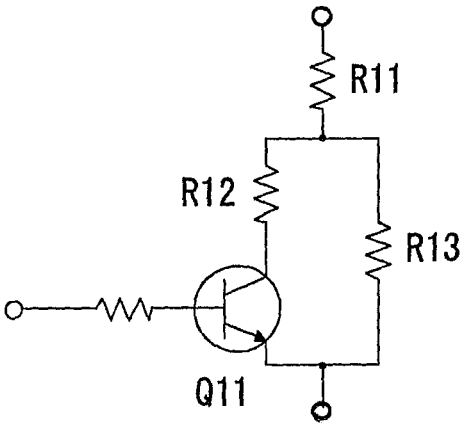
FIG. 11 is an electric circuit diagram showing a control circuit of a floor detection sensor of a self-propelled electric vacuum cleaner according to Embodiment 3 of the present invention.

Hence, the control circuit of the floor detection sensor 13 supports this erroneous recognition by using a circuit which changes a resistance value shown in FIG. 11 instead of the resistance R1 shown in FIG. 10.

That is, a circuit shown in FIG. 11 is formed by connecting a serial circuit including a resistance R12 and an NPN transistor Q11 to a resistance R13 of a serial circuit including a resistance R11 and a resistance R13.

Hence, when the transistor Q11 is turned off, resistance values at both ends of this circuit take $$R11+R13=R1.$$

Meanwhile, when the transistor Q11 is turned on, the resistance values take $$R11+R13\times R12/(R12+R13), \text{ and}$$

are smaller than R11+R13, i.e., R1.

Hence, when an external light sensor 90 shown in FIG. 1 detects a strong infrared beam such as sunlight, the sensor control unit 66 (FIG. 9) receives this signal and turns on the transistor Q11 shown in FIG. 11. By this means, a resistance value corresponding to the resistance R1 in FIG. 10 becomes small, and, even when strong external light (sunlight) is reflected by the floor F and enters the light receiving element 87, the signal of the node (b) becomes a signal in which the pulse signal is superimposed on the DC signal as shown in FIG. 13(*e*).

DC components of this signal are eliminated by the DC component elimination circuit, and a signal shown in FIG. 13(*f*) is inputted to the node (c). This signal is compared with the reference voltage Ref by the comparator U1 and is larger than the reference voltage Ref, then the node (d) outputs a signal shown in FIG. 13(*g*) to the control section 54 (FIG. 9) and the control section 54 recognizes that the floor normally exists.

Meanwhile, when the vacuum cleaner is about to reach a large step (cliff) and reflected light reflected from the floor F and received by the light receiving element 87 weakens, a signal appearing in the node (b) becomes small as shown in FIG. 13(*h*).

Hence, a signal to be inputted to the node (c) also becomes smaller than the reference voltage Ref as shown in FIG. 13(*i*), then a signal does not appear in the node (d) as shown in FIG. 13(*j*), and the control section 54 recognizes that the vacuum cleaner is about to reach the large step (cliff) and causes the vacuum cleaner to stop movement or change a travelling direction.

In this way, the floor detection sensor 13 can prevent an interference of strong external light.

Embodiment 3

Figure 14:
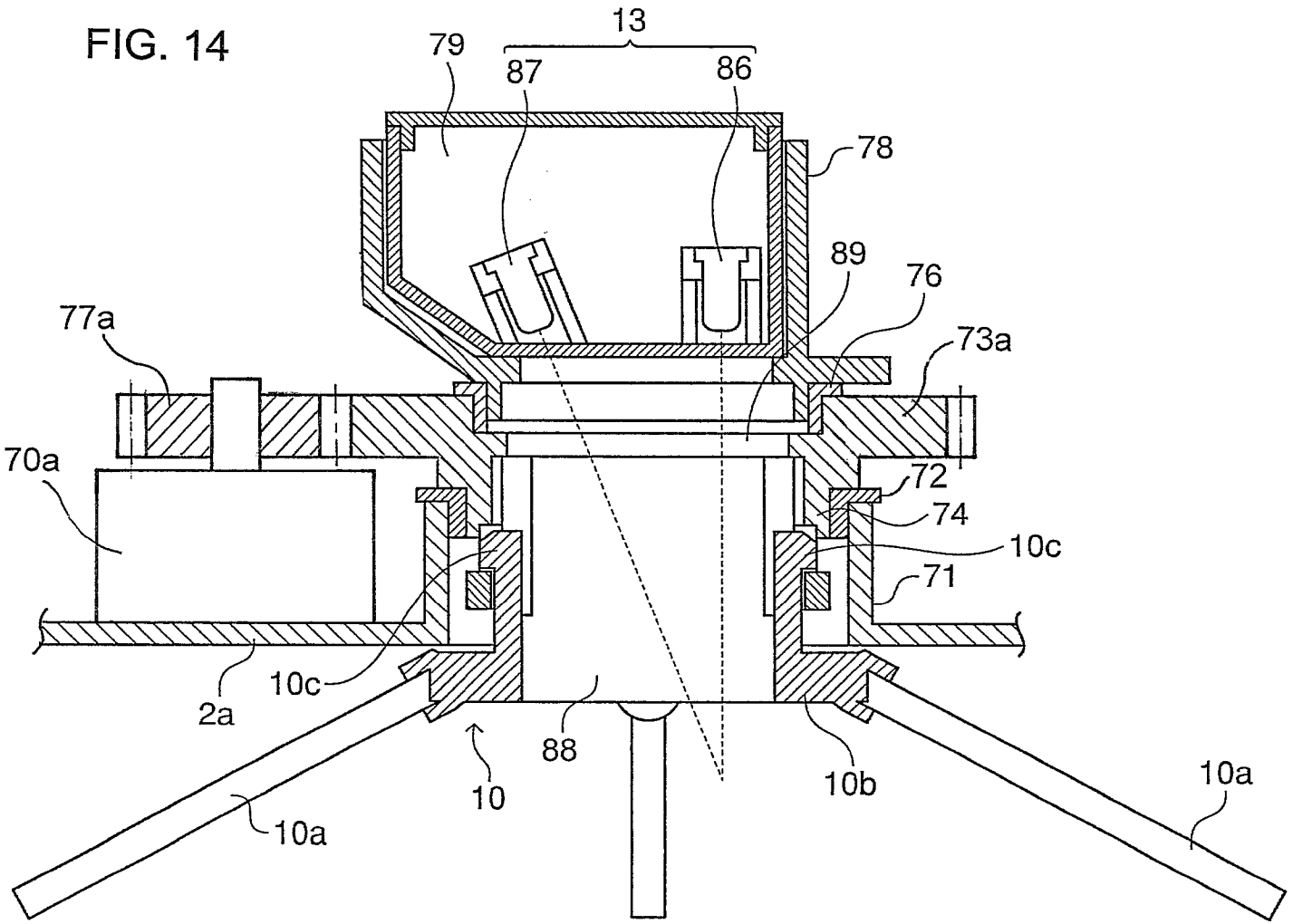
FIG. 14 is a view corresponding to FIG. 8 according to Embodiment 3 of the present invention.

In Embodiment 1, as shown in FIGS. 7 and 8, a rotating shaft 10*b* of a side brush 10, and an output shaft of a driving motor 70 are orthogonal to each other, and are coupled via a worm gear including a worm wheel 73 and a worm 77. In the present embodiment, as shown in FIG. 14, the worm wheel 73, the worm 77 and the driving motor 70 are replaced with spur gears (spur gears) 73*a* and 77*a* and a driving motor 70*a*, respectively, and the rotating shaft 10*b* of the side brush 10 and the output shaft of a driving motor 70*a* are coupled in parallel. Transmission efficiency of a torque of the driving motor improves compared to a case where a worm gear is used. However, when a reduction gear ratio is insufficient, a speed reducer motor (geared motor) needs to be used for the driving motor 70*a*. In addition, the driving motor 70*a* is fixed to a bottom plate 2*a* by using appropriate fastening parts (such as screws or spring washers).

Embodiment 4

An exchange of a side brush 10 will be described in Embodiment 4. The floor detection sensor 13 is not influenced by a shape of a side brush, so that it is possible to easily exchange the side brush 10 such that the side brush can be attached to match a condition of a floor (a wooden floor, a tatami mat or a carpet).

Figure 15:
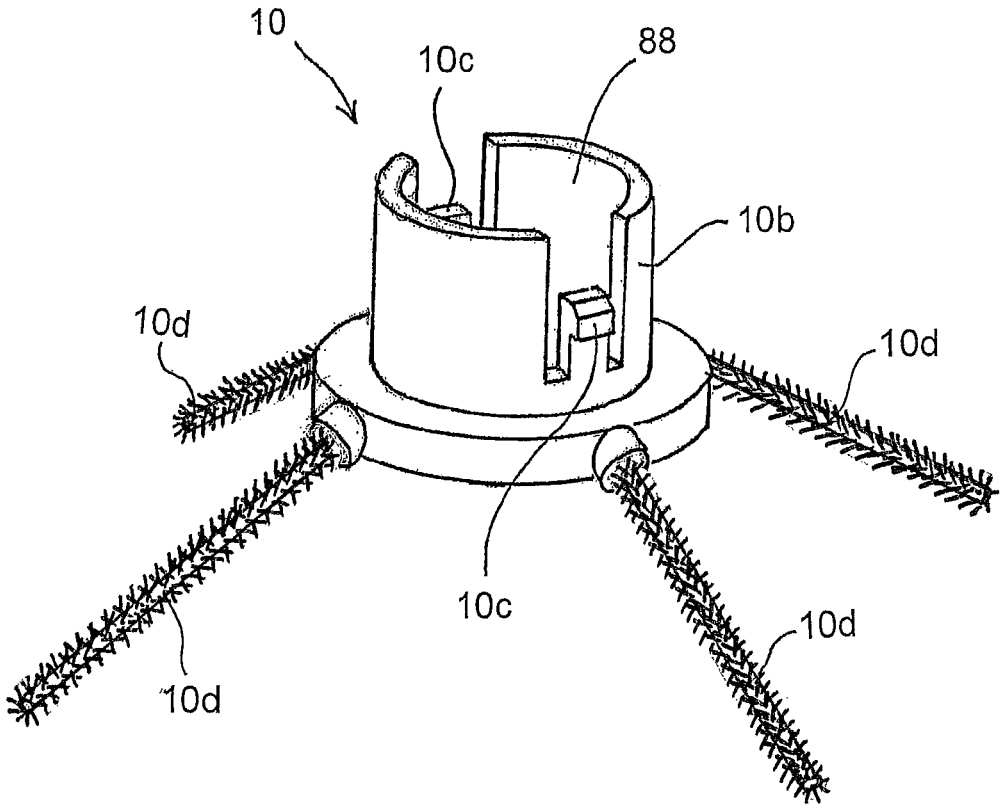
FIG. 15 is a view corresponding to FIG. 6 according to Embodiment 4 of the present invention.
Figure 16:
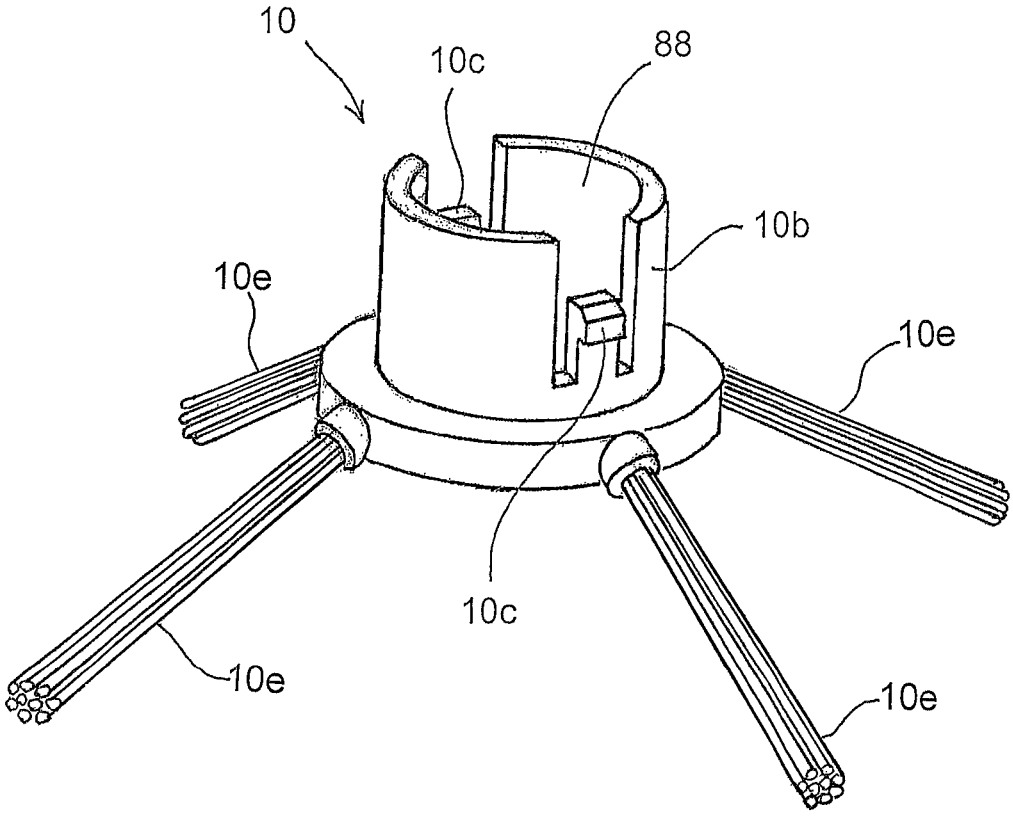
FIG. 16 is a view corresponding to FIG. 6 according to Embodiment 4 of the present invention.

In case of, for example, a wooden floor or a tatami mat, a brush 10*d* formed by disposing resin fine bristle brushes on entire outer circumference surfaces of cores of thin sticks as shown in FIG. 15, and a brush 10*e* formed by forming a plurality of thin and long resins as a bundle as shown in FIG. 16 are used.

In addition, in case of the carpet, if these brushes are used, these brushes tangle with the carpet, and therefore a resin stick brush 10*a* shown in FIG. 6 is used. Further, it is possible to easily exchange the side brush 10 by attaching and detaching elastic locking claws 10*c* shown in FIGS. 7 and 8 to and from locking windows 75 as described above.

DESCRIPTION OF REFERENCE SIGNS

1 SELF-PROPELLED ELECTRIC VACUUM CLEANER
2 HOUSING
2*a* BOTTOM PLATE
9 ROTARY BRUSH
10 SIDE BRUSH
10*a* BRUSH
10*b* ROTATING SHAFT
10*c* LOCKING CLAW
10*d* BRUSH
10*e* BRUSH
13 FLOOR DETECTION SENSOR
22 ELECTRIC BLOWER
29 DRIVING WHEEL
55 DRIVING WHEEL MOTOR
56 DRIVING WHEEL MOTOR
58 BRUSH DRIVING MOTOR
61 SHUNT RESISTOR
62 POWER SWITCH
68 SWITCHING ELEMENT
69 DC MOTOR
70 DRIVING MOTOR
71 CYLINDRICAL PORTION
72 METAL WASHER
73 WORM WHEEL
74 ROTATING SHAFT
75 LOCKING WINDOW
76 METAL WASHER
77 WORM
78 ASSEMBLY FIXING MEMBER
79 SENSOR MODULE
80 MOTOR COVER
81*a*, 81*b* MOTOR SUPPORT PLATE
82 MOTOR FIXING COLUMN
83 MOTOR FIXING COLUMN
84 FIXING MEMBER FIXING COLUMN
85 FIXING MEMBER FIXING COLUMN
86 LIGHT EMITTING ELEMENT
87 LIGHT RECEIVING ELEMENT
88 THROUGH-HOLE
89 THROUGH-HOLE
90 EXTERNAL LIGHT DETECTION SENSOR
91 HOLE
92 MOTOR DRIVER CIRCUIT
R1 FRONT STORAGE ROOM
R2 INTERMEDIATE STORAGE ROOM
C CENTER LINE
F FLOOR
S SIDEWALL
R3 REAR STORAGE ROOM

What is claimed is:

1. A self-propelled electric vacuum cleaner comprising; a vacuum cleaner main body; a running section for causing the vacuum cleaner main body to run on a floor; a suction section for suctioning dust; a side brush for sweeping the dust on the floor, to the suction section; a floor detection sensor for detecting whether or not there is the floor; and a control section for controlling and driving the running section, the suction section and the side brush in response to an output of the floor detection sensor, in which the side brush includes a rotating shaft coaxially having a through-hole, and a plurality of brush bundles radially spread from one end of the rotating shaft, wherein the floor detection sensor includes an optical sensor provided adjacent to the other end of the rotating shaft to detect whether or not there is an object, through the through-hole.

2. The self-propelled electric vacuum cleaner of claim 1 further comprising a first gear coaxially and detachably coupled with the other end of the rotating shaft of the side brush; a support section for rotatably supporting the first gear, and a second gear for meshing with the first gear to transmit a rotation force to the side brush, wherein the first gear includes a through-hole communicated with the through-hole of the side brush, and the optical sensor detects whether or not there is the object, through both of the through-holes of the side brush and the first gear.

3. The self-propelled electric vacuum cleaner of claim 1, wherein the first gear and the second gear compose a worm gear, the first gear being a worm wheel, the second gear being a worm.

4. The self-propelled electric vacuum cleaner of claim 1, wherein the optical sensor includes an infrared light emitting element and an infrared light receiving element.

5. The self-propelled electric vacuum cleaner of claim 1, wherein the side brush is exchangeable.

* * * * *